US005600112A

United States Patent [19]

Opfer

[11] Patent Number: 5,600,112

[45] Date of Patent: Feb. 4, 1997

[54] BUSHING ASSEMBLY WITH CIRCUIT INTERRUPTERS INCLUDING POLYPHASE OPERATING MECHANISM

[75] Inventor: John C. Opfer, Chicago, Ill.

[73] Assignee: S & C Electric Company, Chicago, Ill.

[21] Appl. No.: 499,623

[22] Filed: Jul. 7, 1995

[51] Int. Cl.[6] ..... H01H 33/02; H01H 33/42

[52] U.S. Cl. ..... 218/154; 218/84; 218/155

[58] Field of Search ..... 218/57–67, 116, 218/134, 143, 153, 78, 84, 43–56, 68–83; 337/144, 202

[56] References Cited

U.S. PATENT DOCUMENTS

| | | | |
|---|---|---|---|
| 2,283,693 | 5/1942 | Paul | 218/116 |
| 2,662,947 | 12/1953 | Kyle, Jr. | 337/144 |
| 2,866,032 | 12/1958 | McCloud | 337/202 X |
| 2,979,591 | 4/1961 | Friedrich | 218/57 |
| 3,588,406 | 6/1971 | Bernatt | 218/143 |
| 3,898,406 | 8/1975 | Larkin | 218/134 |
| 4,082,932 | 4/1978 | Rozier et al. | 218/57 X |
| 4,427,860 | 1/1984 | Eley | 218/116 |
| 4,486,635 | 12/1984 | de Calvinoy Teijeiro | 218/57 |
| 4,663,504 | 5/1987 | Barkan | 218/57 |
| 5,128,502 | 7/1992 | Hux | 218/153 |

*Primary Examiner*—J. R. Scott
*Attorney, Agent, or Firm*—J. V. Lapacek

[57] ABSTRACT

A bushing assembly is provided that functions as a circuit interrupter for electrical equipment such as a power transformer or the like. The bushing assembly is mounted so as to extend through the housing of the electrical equipment and incorporates a circuit interrupter having separable interrupter contacts. The bushing assembly includes an insulating bushing and electrical connections for connecting the separable interrupting contacts between a power source connection external to the housing and an input connection internal to the housing that supplies the electrical equipment. The circuit interrupter includes a control arrangement for selectively operating the separable interrupting contacts. In one specific arrangement, the control arrangement is responsive to operate the separable interrupting contacts to interrupt the circuit when the current is above a predetermined level.

7 Claims, 3 Drawing Sheets

BUSHING ASSEMBLY WITH CIRCUIT INTERRUPTERS INCLUDING POLYPHASE OPERATING MECHANISM

BACKGROUND OF THE INVENTION

1. Field of the Invention

The present invention relates generally to circuit interrupters and more particularly to a bushing assembly that provides a circuit-interrupting function for electrical equipment such as a power transformer or the like, the bushing assembly being mounted so as to extend through the housing of the electrical equipment and incorporating a circuit interrupter and providing electrical connection between the exterior power source connections and the internal input connection to the transformer or the like.

2. Description of Related Art

Power transformers and other electrical equipment in the electrical transmission and distribution field are connected to a power source through various combinations of switching and protection devices so as to provide the required protection to the power transformers and electrical equipment as well as desirable versatility and flexibility in supplying the various load circuits in the electrical power system. The switching and/or protective devices include fuses, circuit breakers, and load-break disconnect switches. Typically, these switching and/or protective devices are independent of the power transformer or other electrical equipment in that these devices are separately supported with respect to the ground or a floor and include separate electrical interconnections between these devices and the supplied power transformer or other electrical equipment. For example, see U.S. Pat. Nos. 3,588,406 and 2,979,591. U.S. Pat. No. 4,663,504 illustrates a load-break switch, useful in at least the lower half of the medium voltage range (1–69 kV), that includes a grounded housing with bushings mounted at either end. In one arrangement, the switch is externally connected to a power transformer or other electrical equipment via an elbow connector. Another type of load-break switch, shown in U.S. Pat. No. 4,082,932, includes a metallic tank that is mounted on a wall within electrical equipment, the electrical connections to the load-break switch extending on either side of the wall. U.S. Pat. Nos. 2,662,947 and 2,866,032 illustrate fuse cutouts with bridging or recloser switches that are mounted within a bushing that provides electrical interconnection to the transformer on which the bushing is mounted, with the fusible elements of the fuse cutouts and the switching contacts being immersed within the dielectric fluid of the transformer.

While these various arrangements are generally useful, it would be desirable to provide circuit-interrupting functions for a power transformer or the like via an arrangement that is compact and of minimal additional size and cost to the transformer or other electrical equipment to be protected, while not contaminating the interior of the power transformer or the like with the are products of interruption.

SUMMARY OF THE INVENTION

Accordingly, it is a principal object of the present invention to provide a bushing assembly for a transformer or other electrical equipment that incorporates circuit-interrupting functions.

It is another object of the present invention to provide a bushing assembly that is mounted so as to extend through an electrical equipment enclosure and that incorporates a circuit interrupter connected in circuit between external power source connections and the electrical input to the electrical equipment.

It is a further object of the present invention to provide a circuit-interrupting arrangement for electrical equipment wherein a circuit interrupter is incorporated within an insulating bushing that is carried by the electrical equipment.

It is yet another object of the present invention to provide a circuit-interrupting function for electrical equipment having an enclosure and an insulating bushing extending through the enclosure via the incorporation of a circuit interrupter within the insulating bushing.

These and other objects of the present invention are efficiently achieved by a bushing assembly that provides a circuit interrupter for electrical equipment such as a power transformer or the like. The bushing assembly is mounted so as to extend through the housing of the electrical equipment and incorporates a circuit interrupter having separable interrupter contacts. The bushing assembly includes an insulating bushing and electrical connections for connecting the separable interrupting contacts between a power source connection external to the housing and an input connection internal to the housing that supplies the electrical equipment. The circuit interrupter includes a control arrangement for selectively operating the separable interrupting contacts. In one specific arrangement, the control arrangement is responsive to operate the separable interrupting contacts to interrupt the circuit when the current is above a predetermined level.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
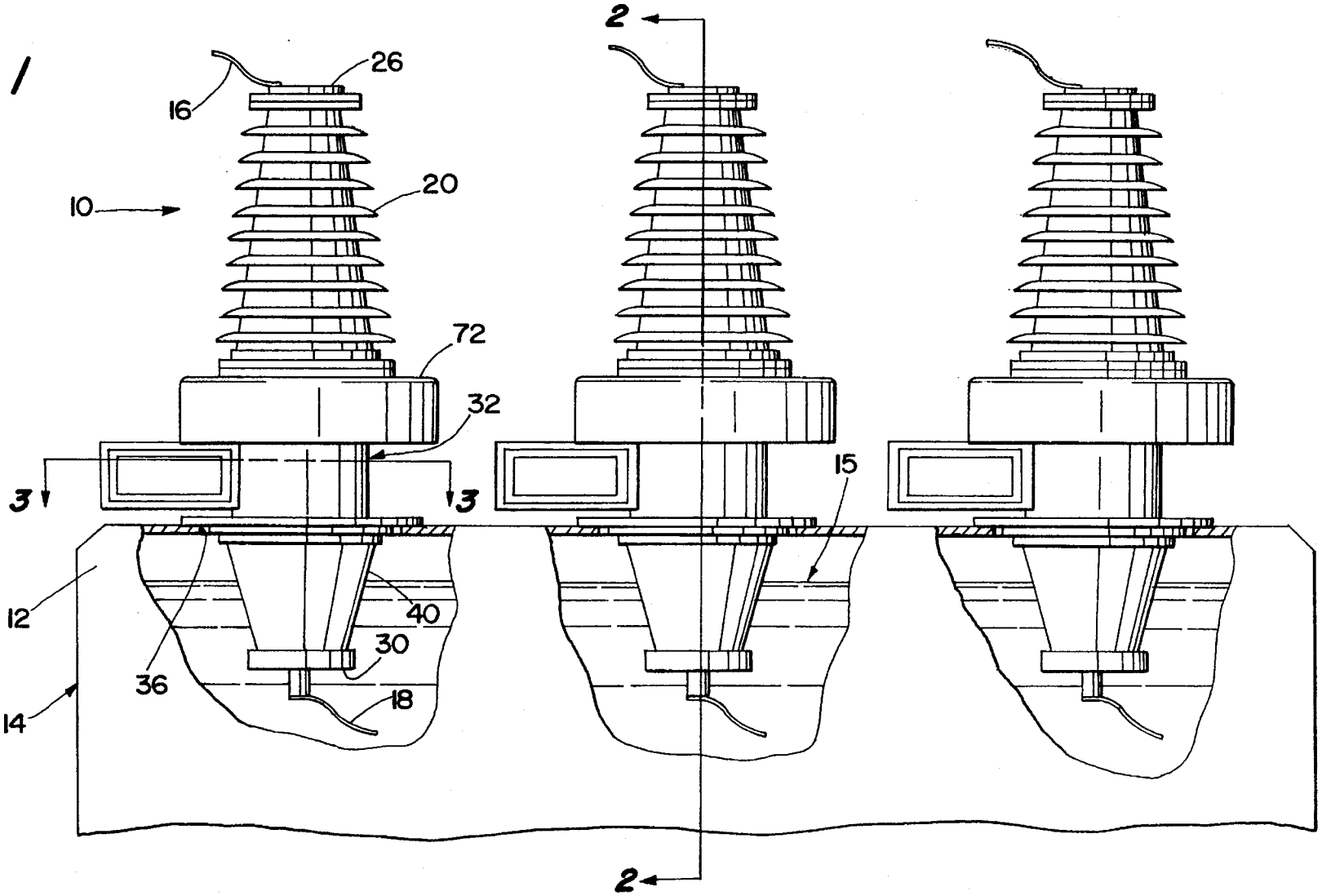
FIG. 1 is an elevational view, with parts cut away, of a polyphase installation of the bushing assembly of the present invention mounted so as to extend through a housing of the illustrated electrical equipment.

Referring now to FIG. 1, the bushing assembly 10 of the present invention is illustrated mounted so as to extend through a housing 12 of electrical equipment 14 such as a power transformer or the like. As shown in FIG. 1, the housing 12 is filled with a dielectric fluid such as oil, generally referred to at 15. The bushing assembly 10 provides the function of a bushing and a circuit interrupter, i.e. providing electrical interconnection through the wall of the housing 12 between an external power source conductor at 16 and the internal power connection to the electrical equipment via the conductor 18 and also providing a circuit-interrupting function between the conductors 16 and 18. As shown in FIG. 1, the connection at 18 is typically below the level of the fluid 15.

Figure 2:
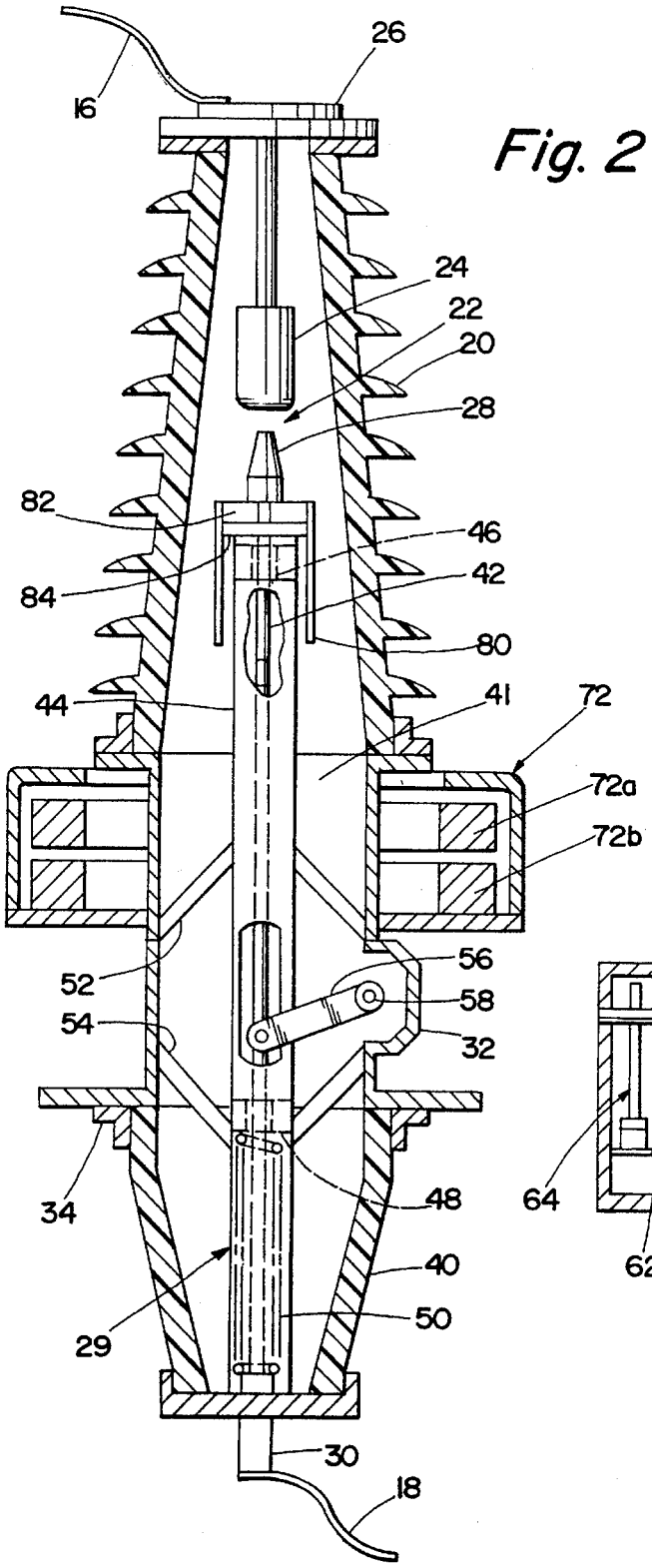
FIG. 2 is an enlarged view, partly in section, taken along the line 2—2 of FIG. 1.

Specifically and referring now additionally to FIG. 2, the bushing assembly 10 includes a first insulating bushing 20 and separable interrupting contacts 22 housed within the first insulating bushing 20. A first contact 24 of the separable interrupting contacts 22 is connected to an upper electrode 26 that is connected to the power source conductor at 16. The second contact 28 of the separable interrupting contacts 22 is connected via an internal conductive path, generally referred to at 29 and discussed in more detail hereinafter, to a lower electrode 30 that is connected to the conductor 18 supplying the electrical equipment 12. The bushing assembly 10 further includes a supporting arrangement 32 that supports the first insulating bushing 20 and that mounts the bushing assembly 10 with respect to the housing 12. The supporting arrangement is at the potential of the housing 12, i.e. system ground potential. In the illustrative embodiment, the supporting arrangement 32 includes a sealing arrangement 34 to provide a seal around the opening 36 through the housing 12 to preserve the sealed internal environment of the electrical equipment 14. The bushing assembly 10 also includes a second insulating bushing 40 that is carried by and extends from the supporting arrangement 32. The bushing assembly 10 defines an internal gas-tight volume within the interconnected first insulating bushing 20, the supporting arrangement 32, and the second insulating bushing 40.

In accordance with important aspects of the present invention, the first insulating bustling 20 includes external dielectric characteristics suitable for outdoor use while the internal circuit-interrupter structure and the second insulating bushing 40 provide grading and stress reducing of the electrical field.

In the preferred embodiment, the bushing assembly 10 is a puffer interrupter and the internal volume, generally referred to at 41, is filled with pressurized dielectric insulating fluid such as $SF_6$ gas. The first contact 24 is a stationary contact and the second contact 28 is a movable contact carried on a movable contact tube 42. The movable contact tube 42 is slidably disposed within a contact tube 44 via an upper bearing assembly 46 and, with the upper bearing assembly 46 also including a sliding contact arrangement to provide electrical connection between the movable contact tube 42 and the lower, electrode 30 via the contact tube 44. An opening spring 50 is disposed between the contact tubes 42 and 44 and is arranged to urge the moving contact tube 42 to the open position as shown in FIG. 2. The contact tube 44 is supported within the bushing assembly 10 via insulating conical support members 52,54 which are disposed within the supporting arrangement 32 and about the contact tube 44. The position and movement of the movable contact tube 42 is controlled via an insulated drive lever arrangement 56. A puffer cylinder 80 illustrated in FIG. 2 is carried with the movable contact 28 so as to pressurize gas within the volume 82 during contact opening and provide a puffer function, the volume 82 being defined between the puffer cylinder 80 and a stationary piston surface 84 at the top of the contact tube 44.

Figure 3:
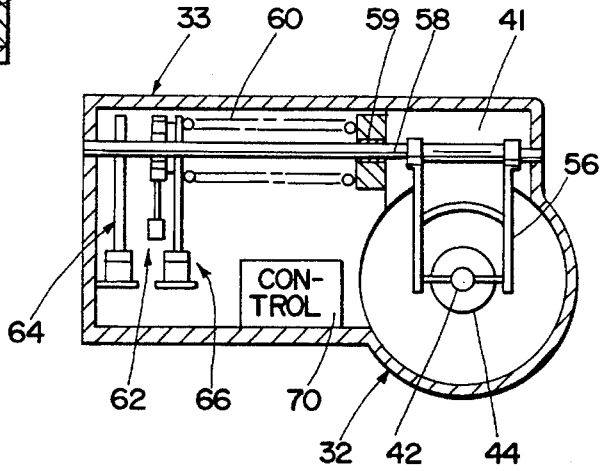
FIG. 3 is an enlarged view, partly in section, taken along the line 3—3 of FIG. 1.

Referring now additionally to FIG. 3, the insulated drive lever arrangement 56 is fixedly carried by a drive shaft 58 which is rotatably carried by the supporting arrangement 32. A seal arrangement 59 is provided about the drive shaft 58 to seal the internal volume 41 from the exterior environment. A torsional closing spring 60 is disposed about the drive shaft 58 and arranged to act between the drive shaft 58 and the supporting arrangement 32. The closing spring 60 is charged via a drive arrangement referred to generally at 62 and a closing cam and latch arrangement 64.

When it is desired to close the contacts 24,28, the closing cam and latch arrangement 64 is tripped and the closing spring 60 via the drive shaft 58 and the drive lever arrangement 56 circuit moves the movable contact tube 42 from the open position as shown in FIG. 2 to the closed position with movable contact 28 moving upward in FIG. 2 and into the stationary contact 24. During this closing movement, the opening spring 50 is charged. Thus, when it is desired to open the contact 24,28, an opening cam and latch arrangement 66 is tripped, releasing the drive shaft 58 and the drive lever arrangement 56 which allows the opening spring 50 to rapidly open the contacts 24,28.

A control arrangement generally referred to at 70, controls the drive input arrangement 62 and the tripping of the opening cam and latch arrangement 66 and the closing cam and latch arrangement 64. A mechanism housing portion 33 of the supporting arrangement 32, external to the internal volume 41, houses the opening cam and latch arrangement 66, the closing cam and latch arrangement 64, the closing spring 60, the control arrangement 70, and the drive shaft 58.

One or more current transformers generally referred to at 72 are disposed about the supporting arrangement 32. For example, in the illustrated embodiment (see FIG. 2), a first current transformer **72*a* is utilized to provide operating power to the control arrangement 70, and a second current transformer 72*b* is utilized to provide a sensed current signal to the control arrangement 70. The control arrangement 70 is responsive to interrupt the circuit between conductors 16,18 via operation of the separable interrupting contacts 22** when the current is above a predetermined level.

Figure 4:
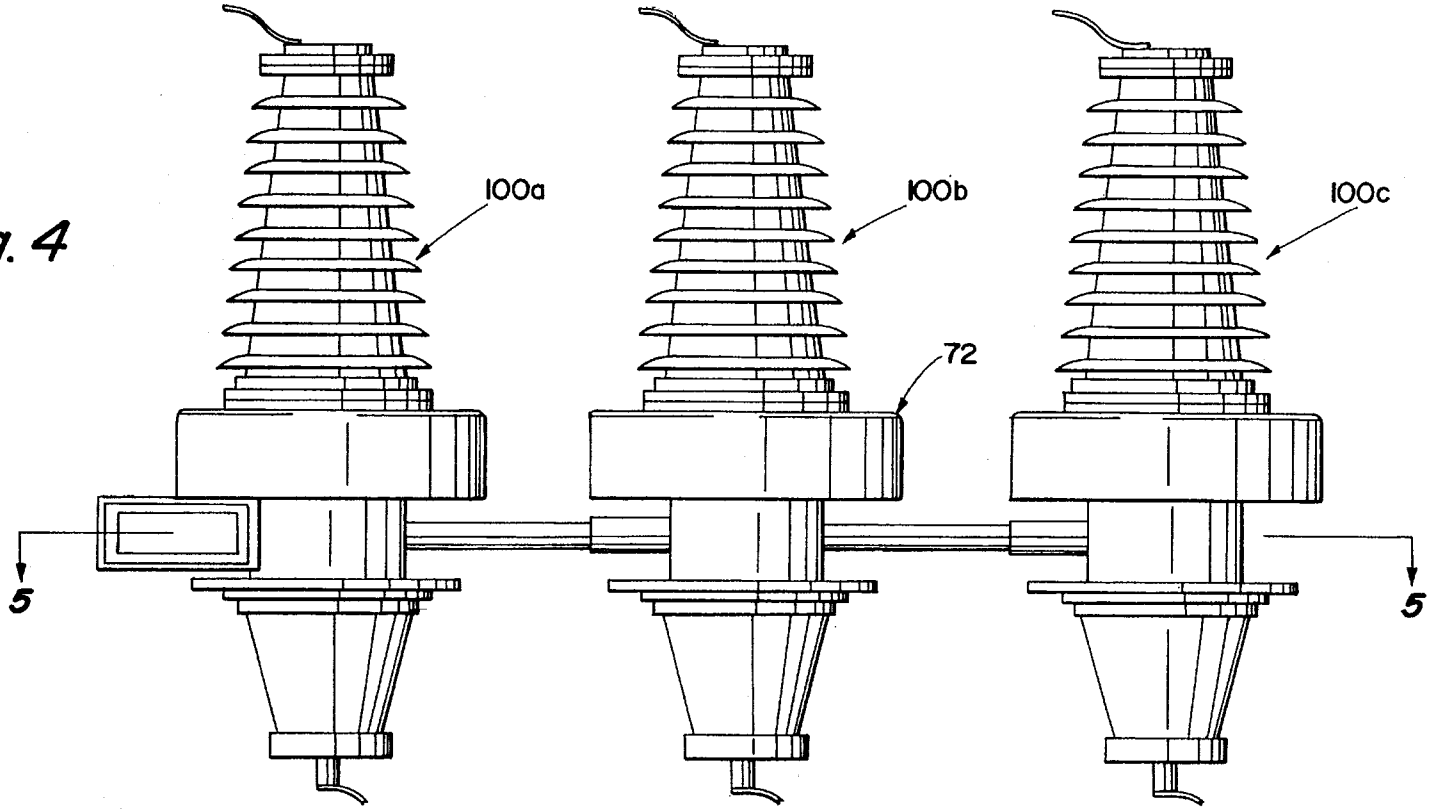
FIG. 4 an elevational view of an alternate embodiment of a bushing assembly in accordance with the principles of the present invention.
Figure 5:
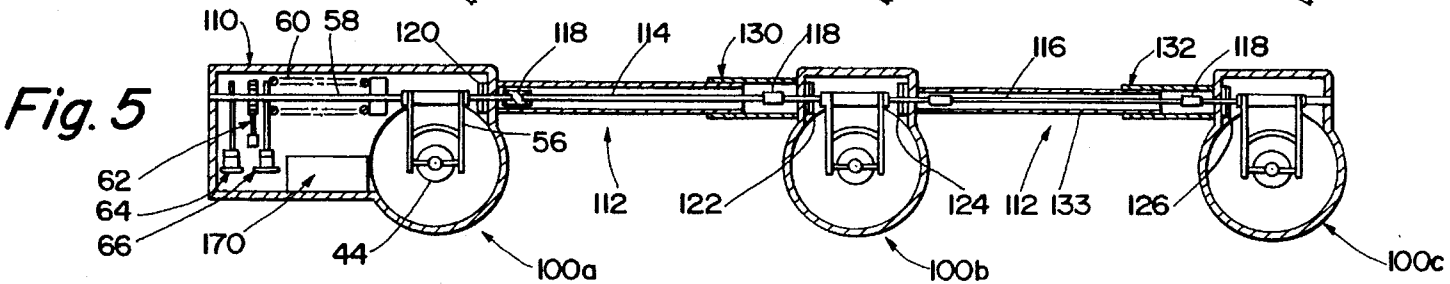
FIG. 5 is a view, partly in section, taken along the line 5—5 of FIG. 4.

In accordance with other features of the present invention and referring now additionally to FIGS. 4 and 5, an alternate embodiment of the bushing assembly of the present invention is illustrated wherein a bushing assembly 100 for each phase is provided and a common operating mechanism 110 is arranged to group operate all the bushing assemblies 100 via a common drive train generally referred to at 112. Thus, operation of the common operating mechanism 110 is utilized to simultaneously trip the bushing assemblies 100 via the common drive train 112 such that the respective contacts 22 are opened via the respective opening springs 50. Similarly, the common operating mechanism 110 via the drive train 112 is also utilized to simultaneously close the contacts 22 and charge the opening springs 50. Specifically, the drive shaft 58 of the common operating mechanism 110 is connected to a first interphase drive shaft 114 to the drive lever arrangement **56*b* of the bushing assembly 100*b*. Similarly, a second interphase drive shaft 116 interconnects the drive lever arrangement 56*b* to the drive lever arrangement 56*c* of the bushing assembly 100*c*. Interphase drive-shaft couplings 118 are provided to interconnect the drive shaft 58 to the first and second interphase drive shafts 114, 116. Suitable seals 120, 122, 124, and 126 are provided for sealing the internal volumes of the bushing assemblies 100*a*, 100*b* and 100*c*. In the preferred embodiment, the interphase drive shafts 114 and 116 are enclosed by tubes arrangements 130, 132, which are provided by telescoping tubes, e.g. 133 and 134. In this arrangement, the control arrangement 170 receives sensed current signals from the transformers 72 of the bushing assemblies 100*a* , 100*b* and 100*c*** to control tripping when the current in any phase exceeds a predetermined value.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A circuit-interrupting device comprising:

a first insulating bushing;

a second insulating bushing;

a pair of separable contacts within said first insulating bushing;

housing means for supporting said first insulating bushing and said second insulating bushing, said first insulating bushing extending from a first side of said housing means and said second insulating bushing extending from a second side of said housing means; and means for operating said pair of separable contacts between closed and opened positions in response to a drive input, said operating means being supported by said housing means and carrying at least one of said pair of separable contacts, said first insulating bushing including means for providing a first electrical connection to a first of said separable contacts, said second insulating bushing including means for providing a second electrical connection to the second of said separable contacts, said housing means including means for mounting said circuit-interrupting device with respect to and through a predetermined surface that includes a predetermined opening such that said first insulating bushing extends from a first side of the predetermined surface and said second insulating bushing extends from a second side of the predetermined surface, said first insulating bushing including external dielectric characteristics suitable for an outdoor environment, said drive input being located at said housing means and on said first side of the predetermined surface.

2. The circuit-interrupting device of claim 1 wherein said second insulating bushing includes dielectric characteristics for providing grading and stress reducing of electrical fields that are suitable for an electrical connection within a dielectric fluid.

3. The circuit-interrupting device of claim 1 wherein said operating means comprises drive coupling means responsive to said drive input and extending external to said housing means.

4. The circuit-interrupting device of claim 3 wherein said operating means further comprises first energy storage means for moving said first of said separable contacts from a closed position to an open position.

5. The circuit-interrupting device of claim 4 further comprising mechanism means for providing said drive input, said mechanism means including second energy storage means for moving said drive coupling means to position said first of said pair of separable contacts into a closed position with the second of said pair of separable contacts.

6. The circuit-interrupting device of claim 1 further comprising operating mechanism means for providing said drive input, said operating mechanism means including energy storage means, said housing means further comprising mechanism housing means for housing said operating mechanism means.

7. An assembly of a power transformer and a circuit-interrupting device comprising:

a power transformer including a housing and at least one electrical connection point internal to said housing;

a circuit-interrupting device mounted with respect to said housing of said power transformer and extending both external to said housing and into the interior of said housing for providing electrical connection from a point external to said power transformer at said at least one electrical connection point, said circuit-interrupting device comprising:

a first insulating bushing;

a second insulating bushing;

a pair of separable contacts within said first insulating bushing;

housing means for supporting said first insulating bushing and said second insulating bushing, said first insulating bushing extending from a first side of said housing means and said second insulating bushing extending from a second side of said housing means;

means for operating said pair of separable contacts between closed and opened positions in response to a drive input, said operating means being supported by said housing means and carrying at least one of said pair of separable contacts; said first insulating bushing including means for providing a first electrical connection to a first of said separable contacts, said second insulating bushing including means for providing a second electrical connection to the second of said separable contacts, said housing means including means for mounting said circuit-interrupting device with respect to and through a predetermined surface that includes a predetermined opening such that said first insulating bushing extends from a first side of the predetermined surface and said second insulating bushing extends from a second side of the predetermined surface, said first insulating bushing including external dielectric characteristics suitable for an outdoor environment; and operating mechanism means for providing said drive input, said operating mechanism means including energy storage means, said housing means further comprising mechanism means for housing said operating mechanism means, said drive input being located at said housing means and on said first side of said predetermined surface.

* * * * *

UNITED STATES PATENT AND TRADEMARK OFFICE

CERTIFICATE OF CORRECTION

PATENT NO. : 5,600,112

DATED : Feb. 4, 1997

INVENTOR(S) : John C. Opfer

It is certified that error appears in the above-identified patent and that said Letters Patent is hereby corrected as shown below:

Col. 3, line 39, after "46 and" insert -- a lower bearing assembly 48 --.

Signed and Sealed this

Thirtieth Day of September, 1997

Bruce Lehman

*Attest:*

BRUCE LEHMAN

*Attesting Officer*

*Commissioner of Patents and Trademarks*